US010369722B2

(12) United States Patent
Frey et al.

(10) Patent No.: US 10,369,722 B2
(45) Date of Patent: Aug. 6, 2019

(54) CONTROL FOR A TRUCK MIXER

(75) Inventors: Werner Frey, Oggelshausen (DE); Berthold Ruf, Schoenebuerg (DE)

(73) Assignee: Liebherr—Mischtechnik GmbH, Bad Schussenried (DE)

( * ) Notice: Subject to any disclaimer, the term of this patent is extended or adjusted under 35 U.S.C. 154(b) by 1524 days.

(21) Appl. No.: 12/148,326

(22) Filed: Apr. 18, 2008

(65) Prior Publication Data

US 2008/0279036 A1 Nov. 13, 2008

(30) Foreign Application Priority Data

Apr. 19, 2007 (DE) ..... 20 2007 005 706 U

(51) Int. Cl.
*B28C 5/18* (2006.01)
*B28C 5/42* (2006.01)

(52) U.S. Cl.
CPC ..... *B28C 5/422* (2013.01)

(58) Field of Classification Search
CPC ..... B28C 5/422
USPC ..... 366/61
See application file for complete search history.

(56) References Cited

U.S. PATENT DOCUMENTS

| | | | | |
|---|---|---|---|---|
| 5,214,916 | A | 6/1993 | Lukich | |
| 5,611,751 | A * | 3/1997 | Ehrenhardt et al. | 477/73 |
| 6,550,351 | B1 * | 4/2003 | O'Reilly et al. | 74/335 |
| 2005/0131600 | A1 * | 6/2005 | Quigley et al. | 701/33 |

FOREIGN PATENT DOCUMENTS

| | | |
|---|---|---|
| DE | 12 48 530 | 8/1967 |
| DE | 33 17 419 | 11/1984 |
| DE | 38 24 414 | 2/1990 |
| EP | 1213174 | 6/2002 |
| JP | 1-249521 | 10/1989 |
| JP | 2002-172612 | 6/2002 |
| JP | 2006-239943 | 9/2006 |

* cited by examiner

*Primary Examiner* — Robert J Grun
(74) *Attorney, Agent, or Firm* — Dilworth & Barrese, LLP

(57) ABSTRACT

The present invention relates to a control for truck mixers having a hydraulically driven mixer drum, with the hydraulic pump of the mixer drive being driven by the drive motor of the truck mixer or by a separate motor. In accordance with the invention, the speed of the drive motor is adjustable in dependence on the demanded drum speed, with the desired drum speed being able to be set via an operating lever.

11 Claims, 3 Drawing Sheets

CONTROL FOR A TRUCK MIXER

BACKGROUND OF THE INVENTION

The invention relates to a control for a truck mixer having a hydraulically driven mixer drum, with the hydraulic pump of the mixer drive being driven by the drive motor of the truck mixer or by a separate motor.

Truck mixers have a respective hydraulically driven mixer drum, with the hydraulic pump of the mixer drive being driven by the drive motor of the truck mixer. The hydraulic pump of the mixer drive is usually flanged to the power takeoff of the truck engine, usually an internal combustion engine. At a very low speed of the internal combustion engine, the torque taken off at the power takeoff may not be so high to avoid engine damage. The engine speed is therefore raised to a required minimum speed as soon as the drum should be moved.

The operators usually let the internal combustion engine turn at a high speed to have sufficient reserves for the drum speed. Such high speeds of the internal combustion engine are, however, very frequently unnecessary for the drive of the drum at the desired drum speed. This results in unnecessarily high wear, high noise emission and a high consumption of the internal combustion engine.

SUMMARY OF THE INVENTION

It is the object of the present invention to provide a control for a mixer drive of truck mixers which is, on the one hand, user friendly for the operator and, on the other hand, gentle on the drive motor of the truck mixer and optimized with respect to consumption.

This object is solved in accordance with the invention by the combination of the features herein. Accordingly, a control is provided for truck mixers having a hydraulically driven mixer drum, with the hydraulic pump of the mixer drive being driven by the drive motor of the truck mixer or by a separate motor. Furthermore, the speed of the drive motor is adjustable in dependence on the demanded drum speed, with the desired drum speed being able to be set via an operating lever.

In accordance with the invention, the operator can control the rotary movement of the mixer drum of the truck mixer in accordance with the feeling familiar to him for a mechanical lever operation, with the speed of the internal combustion engine being set automatically in dependence on the drum speed demanded by means of the operating lever. The internal combustion engine can thus be operated in the ideal speed range thanks to this automatic setting so that it runs in a manner gentle on the engine, with minimized noise and optimized with respect to consumption. However, with this solution, the decision on having to set the right speed of the internal combustion engine is taken away from the operator. He can thus concentrate on his actual work. The feeling for mechanical lever operation familiar to many operators is combined in accordance with the present invention with the advantages of the electrical control.

Preferred embodiments of the invention also result from the description herein.

Accordingly, the signals can be transmitted in a contact free manner from the operating lever to the control. A contact free control of the operating lever can be implemented via Hall sensors, for example. These Hall sensors pick up the position of the operating lever and forward it to the control. High operational security is ensured based on this contact free signal transmission since the operating lever is hereby insensitive to dirt and is protected against moisture.

The required speed of the drive motor is advantageously determined while taking account of the engine map.

A pushbutton operating element can additionally be provided beside the operating lever. The same control functions can optionally be realized via this pushbutton operating element as is the case with the operating lever.

Additional acceleration ramps and deceleration ramps can be adapted individually and in dependence on the load via the pushbutton operating element.

The operating lever is preferably pivotable by 45° to two sides from a central position, with the drum speed being varied proportionally to the deflection.

In accordance with another advantageous embodiment of the invention, the operating lever can additionally have an operating button, with a switch signal for the fast stop of the mixer drum being actuable by the button actuation.

The pushbutton operation element can furthermore advantageously be made in a two-component plastic construction, with the pushbuttons and the body consisting of a hard plastic and the connection of pushbuttons and body consisting of a soft plastic. A control is hereby realized which is insensitive to dirt, protected against water jets and resistant to cleaning agents.

BRIEF DESCRIPTION OF THE DRAWINGS

Further features, details and advantages of the invention will be explained in more detail with reference to an embodiment shown in the drawing. There are shown.

DESCRIPTION OF THE PREFERRED EMBODIMENTS

Figure 1:
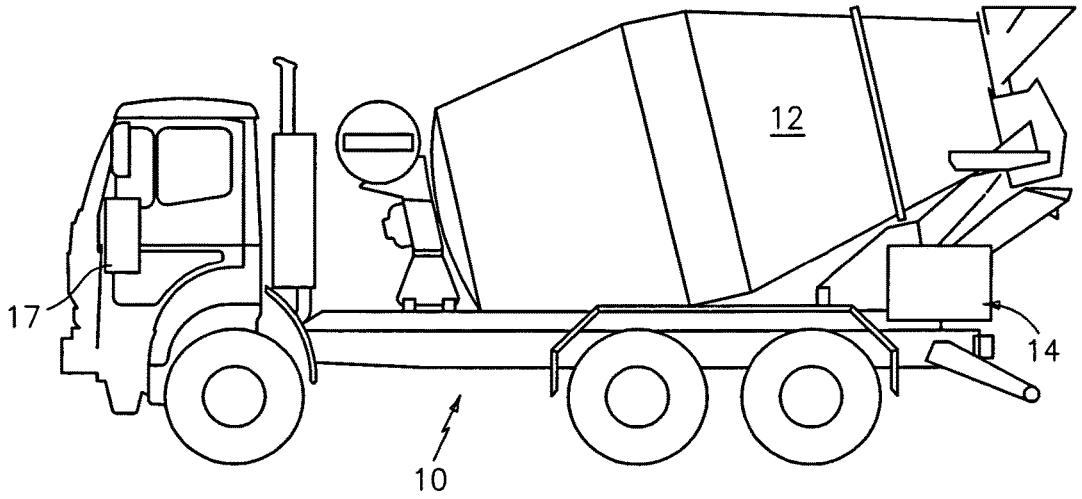
FIG. 1: a schematic representation of a mixer vehicle with the control in accordance with the invention.
Figure 2:
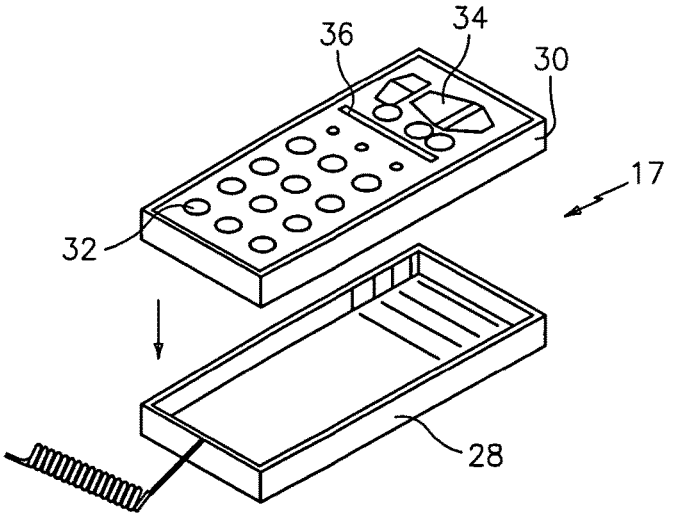
FIG. 2: an operating part of the control in accordance with FIG. 1.

A conventional construction truck mixer 10 is shown in FIG. 1 which has a hydraulically driven mixer drum 12 in addition to the internal combustion engine, not shown in any more detail here, as the drive motor. The mixer drum is driven in a known manner via a hydraulic mixer drive. The hydraulic pump of this hydraulic mixer drive is flanged to the power takeoff of the internal combustion engine driving the truck mixer.

Figure 3:
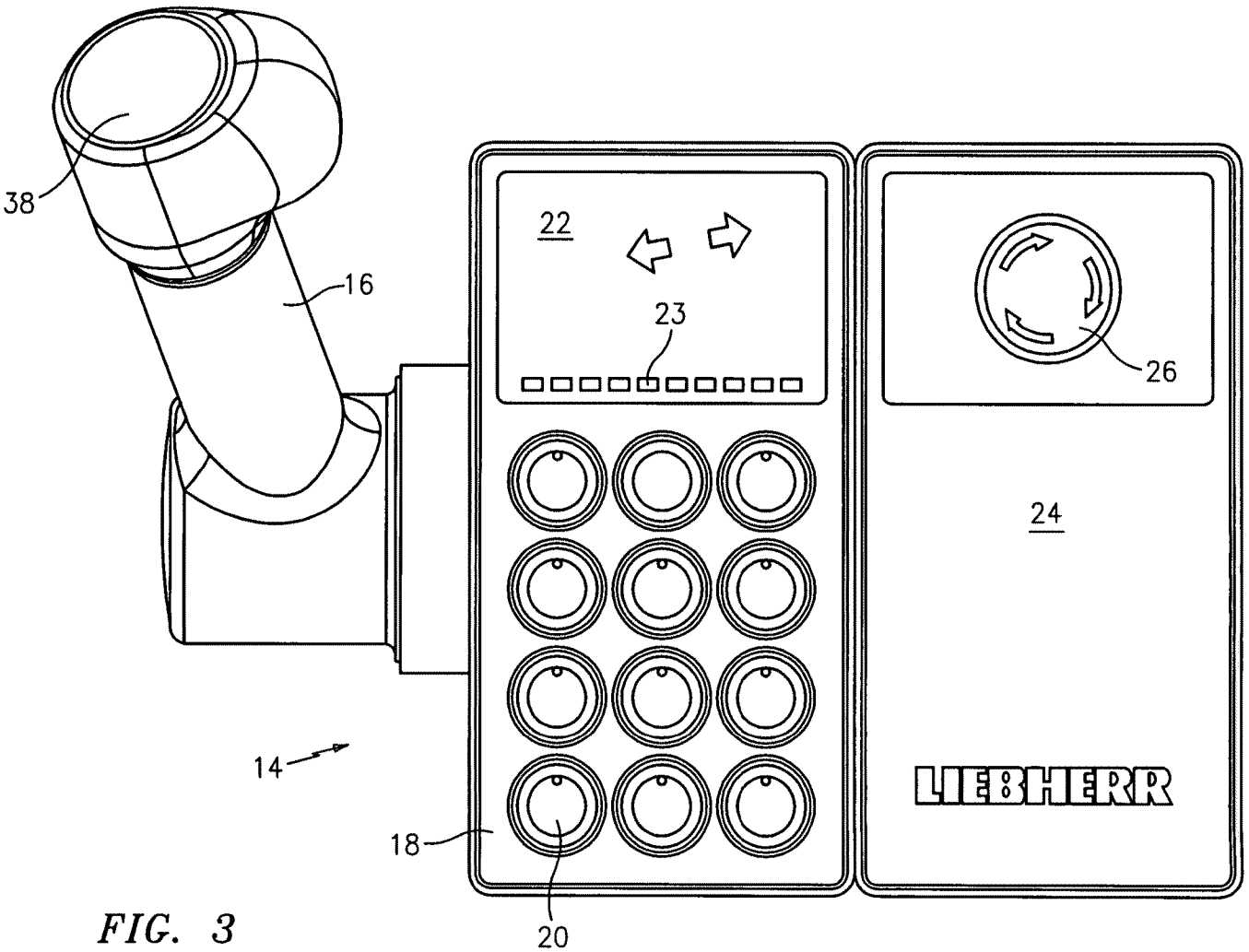
FIG. 3: the main operating part of the control.

The truck mixer 10 has a control for the mixer operation. The control has two operating systems 14 and 17. The operating system 14 has a three-part structure and includes an operating lever 16, an operating part 18 with a pushbutton field 20 and a screen 22 and includes a console 24 with an emergency off switch 26 (cf. FIG. 3). This operating part 14 is arranged laterally in the rear region of the truck mixer 10, as is shown in FIG. 1.

However, a further operating part 17 is provided in the operator's cabin which consists of a lower shell 28 and an operating part 30. This operating part has a similar structure to the previously named operating part 18 since it also has a pushbutton field 32 and a display 34. All the operating elements, namely the operating part 17 and the operating elements 16, 18 and 26 of the operating part 14 are connected via a BUS, e.g. a CAN BUS, to the hydraulic control, to the travel motor control or to a separate motor control (if a separate motor is present), to a possibly present radio remote control and to an optionally present telematics system such as a GPRS status indicator.

All the designated functions of the truck mixer superstructure should be operated and visualized using the operating system in total. The operation can now take place at a plurality of positions at the truck mixer, that is via the operating element 14 at the outside of the truck mixer (optionally cable connected) and additionally in the operator's cabin via the operating element 17. The BUS enables the communication between the components of the operating system and the hydraulic control in this context.

The pushbutton fields 20 and 32 in the operating parts 18 and 30 respectively have twelve pushbuttons in which all the functions of the drum structure can be controlled. Only three pushbuttons are used in the simple case.

A respectively provided LED icon 23 on the screen 22 or 36 on the display 34 shows the drum speed. Further LED bars visualize the rotary movement of the drum as running lights.

The speed of the drive motor of the truck mixer, that is of an internal combustion engine in the present case, is set in dependence on the demanded drum speed based on an automatic control. The drum speed of the mixer drum 12 is set via the operating lever 16. In this connection, the operating lever is pivotable, for example by 45°, to two sides from a central position, with the drum speed being varied proportionally to the deflection. The drum turns in one direction or in the opposite direction depending on the direction of the deflection.

Figure 4:
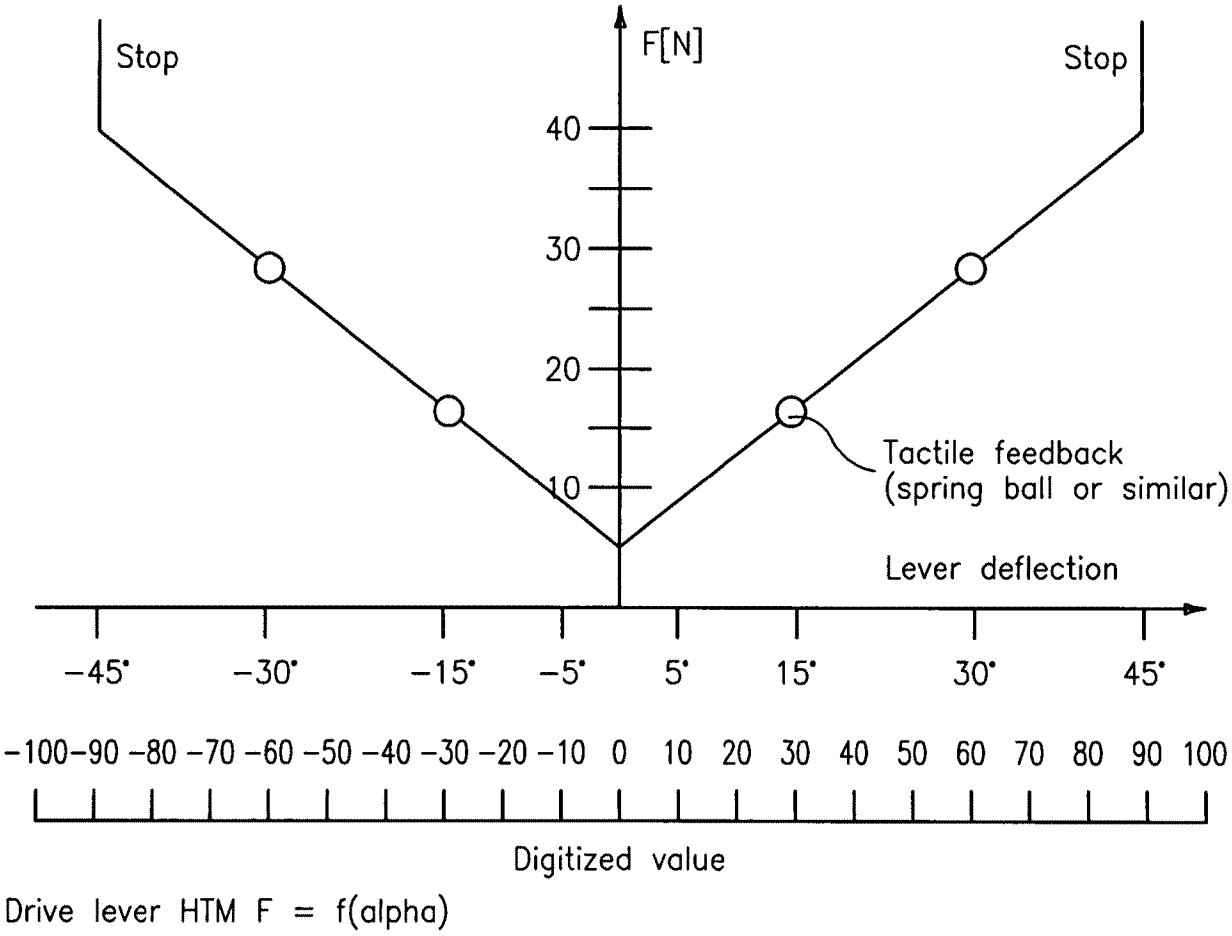
FIG. 4: a diagram in which the force curve for the operating lever actuation is entered over the lever deflection.

The force curve for the lever deflection of the operating lever 16 starting from the zero position can be read off with reference to FIG. 4. The force required for the deflection of the lever increases in dependence on the angular position. Four tactile feedback points are defined via spring balls or similar and are shown in FIG. 4.

The operating operator feels a small resistance at these points which gives him an indication for the position of the operating lever 16 reached.

The operating lever 16 additionally has an operating button 38. A contact free switching pulse is switched by actuation of the button 38 and said switching pulse leads to the fast stop or the memory sensing device of the mixer drum 12. This switching signal of the operating button 38 or the respective degree of deflection of the operating lever 16 is transmitted to the motor control in digitized form via the BUS. The motor control now ensures that the internal combustion engine is operated at a speed which is required to be able to drive the mixer drum 12 at the preselected speed via the hydraulic pump of the hydraulic drive. This means that the drum speed adjustment takes place intuitively, that is, the operator can control the drum speed "blindly" by the lever haptics as with the widespread lever operation and can even regulate it with this control. In addition, the operator actually does not have to worry about the speed of the internal combustion engine. The control of the mixer drive cannot only take place by the operating lever 16, but also by the pushbutton 20 and 32.

The operating parts 14 and 17 are protected against water jets in the present embodiment and are resistant to cleaning agents and insensitive to dirt. This is achieved with the operating lever 16 in that it transmits its signal in a contact free manner to the control. This is made possible in the operating lever 16 by Hall sensors which are not shown in any more detail here and which poll the respective position of the operating lever and forward it as a signal via the BUS to the control. The pushbutton elements 20 and 32 are in turn made together with the respective housing in a two component plastic construction, with the pushbuttons and the body being made of a hard plastic and the connection of pushbuttons and body being made of a soft plastic. The total apparatus is insensitive to dirt due to this one piece aspect. The blocking of the operating parts is possible to prevent any unauthorized or accidental operation. A service indication can additionally take place in the display.

The invention claimed is:

1. A control is provided for truck mixers having a hydraulically driven mixer drum (12), with the hydraulic pump of the mixer drive being driven by the drive motor of the truck mixer or by a separate motor, wherein the drive motor of the truck mixer (10) is an internal combustion engine and speed of the drive motor is settable in dependence on the demanded drum speed, and comprising a first operating system (14) is arranged to adjust the desired drum speed via an operating lever (16) in dependence on requirements to automatically set the speed of the internal combustion engine in dependence on the demanded drum speed and operate the internal combustion engine in an ideal speed range with respect to noise and consumption, a pushbutton array (20) is arranged upon a casing for the operating lever (16) and provided beside the operating lever (16) to separately adjust acceleration ramps and delay ramps individually and in dependence on load via the pushbutton operating array (20), a second operating system (17) is in an operator's cab and having a lower shell (28) and an operating part (30) in turn having a pushbutton field (32) and connected to the first operating system (14) via a BUS configured to enable simultaneous operation, the first operating system (14) comprises a three-part structure, a first part being the operating lever (16), a second part (18) comprising the push button array (20) and a screen (22) in turn including an LED icon (23), and a third part including a console (24) having an emergency off-switch (26), said first operating system (14) is arranged laterally in a rear region of the truck mixer (10), said second operating system (17) comprises a lower shell (28) and an operating part (30) received in the lower shell (28) and in turn comprising the pushbutton field (32) and a display (34), and the screen (22) and display (34) both illustrate a force curve for deflection of the operating lever (16) starting from zero position and which increases in dependence on angular position and comprises four tactile feedback points defined by spring balls to provide small resistance indicating position reached by the operating lever (16), such that all control of the mixer operation takes place at a plurality of positions, including at the mixer (10) and in the operator's cab.

2. A control in accordance with claim 1, wherein all signals are transmitted in a contact free manner from the operating lever (16) to the control.

3. A control in accordance with claim 1, wherein a diesel engine is used as the drive motor.

4. A control in accordance with claim 1, wherein the operating lever (16) is pivotable by 45° to two sides from a central position, with the drum speed being varied proportionally to the deflection.

5. A control in accordance with claim 1, wherein the operating lever (16) additionally has an operating button (38) on an end thereof, with a switching signal being actuable by the button actuation for quick stop of the mixer drum (12).

6. A control in accordance with claim 1, wherein the position of the operating lever (16) is picked up via at least one Hall sensor and forwarded to the control.

7. A control in accordance with claim 1, wherein the pushbutton element (30) of the first operating system (14) is a two component plastic construction, with the pushbuttons (20) and the body composed of a hard plastic and the connection of pushbuttons (20) and body composed of a soft plastic.

8. A control in accordance with claim 1, wherein the pushbutton element (20) of the first operating system (14) comprises three pushbuttons.

9. A control in accordance with claim 8, wherein the pushbutton element (20) comprises twelve pushbuttons.

10. A control in accordance with claim 1, wherein the pushbutton element (20) of the first operating system additionally comprises a screen (22) showing drum speed, an LED icon (23) on the screen (22) and an emergency off switch (26).

11. A control in accordance with claim 1, wherein the first operating system (14) is arranged laterally in a rear region of the truck mixer (10).

* * * * *